United States Patent [19]

Hoffmann

[11] 4,108,710

[45] Aug. 22, 1978

[54] APPARATUS FOR APPLYING LABELS TO CONTAINERS

[75] Inventor: Wolfgang Hoffmann, Modesto, Calif.

[73] Assignee: B & H Manufacturing Company, Inc., Ceres, Calif.

[21] Appl. No.: 480,044

[22] Filed: Jun. 17, 1974

Related U.S. Application Data

[60] Division of Ser. No. 226,064, Feb. 14, 1972, Pat. No. 3,834,963, which is a continuation-in-part of Ser. No. 5,187, Jan. 23, 1970, Pat. No. 3,765,991.

[51] Int. Cl.[2] ..... B65C 9/04

[52] U.S. Cl. ..... 156/450; 156/458; 156/521; 156/567

[58] Field of Search ..... 156/212, 215, 256, 291, 156/363, 450, 458, 519, 521, 566, 567, 568, 578; 118/249; 83/349

[56] References Cited

U.S. PATENT DOCUMENTS

| | | | |
|---|---|---|---|
| Re. 24,097 | 11/1955 | Vonhofe | 156/212 |
| 1,738,076 | 12/1929 | Molins | 83/349 |
| 3,159,521 | 12/1964 | Pechmann | 156/499 |
| 3,196,724 | 7/1965 | Frank | 83/349 |
| 3,404,059 | 10/1968 | Ritterhoff | 156/363 |
| 3,472,722 | 10/1969 | Hutchinson | 156/566 |
| 3,607,579 | 9/1971 | Enskat et al. | 118/249 |
| 3,690,997 | 9/1972 | Bofinger et al. | 156/215 |
| 3,765,991 | 10/1973 | Hoffman | 156/230 |
| 3,772,120 | 11/1973 | Radzins | 156/521 |
| 3,783,058 | 1/1974 | Solomon et al. | 156/521 |

*Primary Examiner*—Caleb Weston

*Attorney, Agent, or Firm*—Edward B. Gregg; Stanley Bialos

[57] ABSTRACT

Method and apparatus for continuous high speed application of labels to containers wherein the adhesive is applied to a predetermined location upon each of a succession of containers moved past a vacuum drum applying the leading edge of a label to each container at such location. The labels are successively cut from a strip by means ensuring continuous label movement and have an adhesive applied to a trailing edge thereof before application to containers. The containers are then moved to a discharge station where the labels are wrapped about the containers.

4 Claims, 16 Drawing Figures

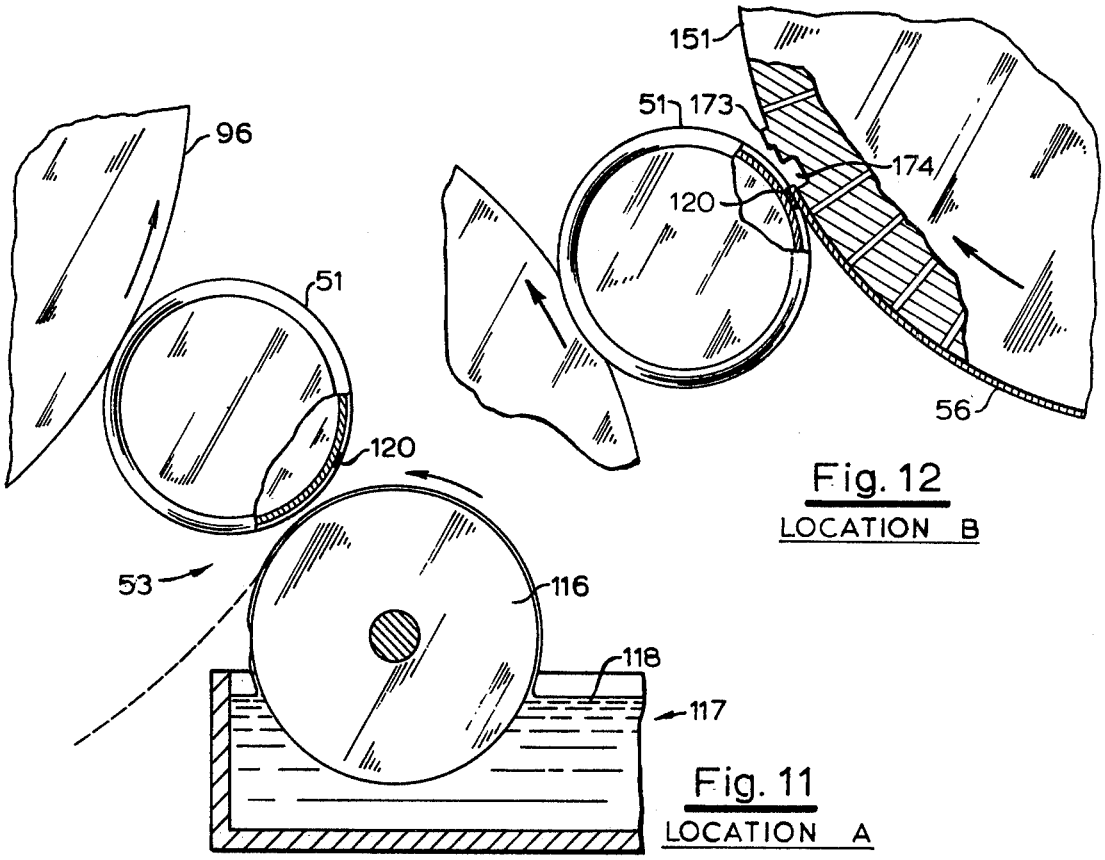
Fig. 12
LOCATION B
Fig. 11
LOCATION A
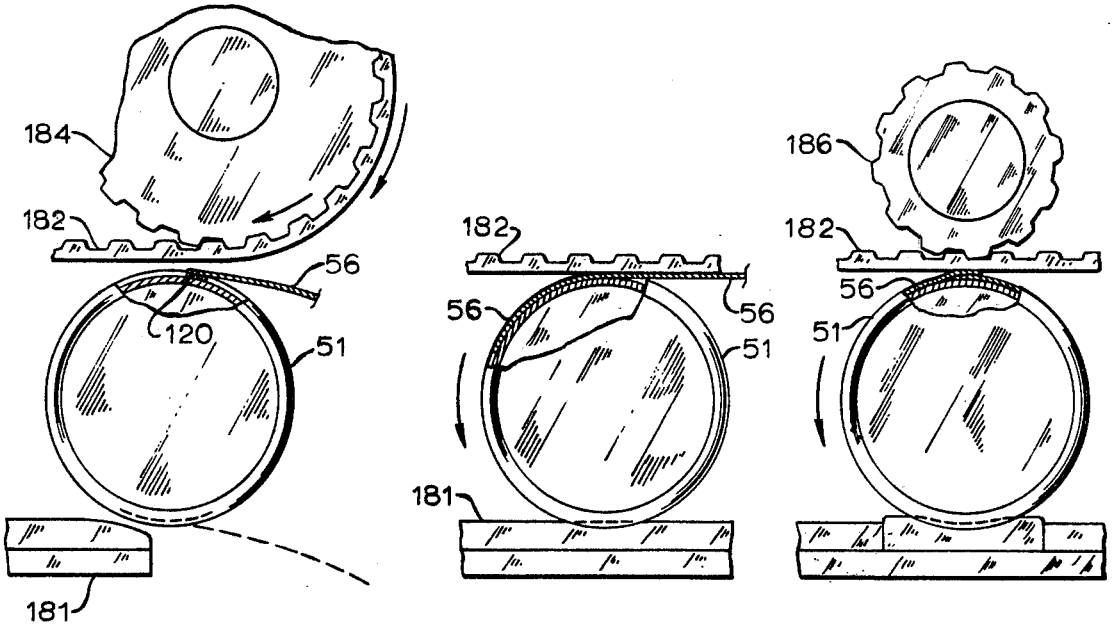
Fig. 13
LOCATION C
Fig. 14
LOCATION D
Fig. 15
LOCATION E

APPARATUS FOR APPLYING LABELS TO CONTAINERS

BACKGROUND OF INVENTION

This application is a division of my copending application, Ser. No. 226,064, filed Feb. 14, 1972, U.S. Pat. No. 3,834,963 which in turn is a continuation-in-part of my application, Ser. No. 5,187, filed Jan. 23, 1970 upon which U.S. Pat. No. 3,765,991, dated Oct. 16, 1973, was granted.

It is conventional in the application of labels to containers such as cans or the like for rather complicated and cumbersome equipment to be employed. Conventional equipment in this general field usually includes automatic label feeding magazines with glue applying means and can rotating means.

The commercial labeling of cans employed in commerce as containers for vegetables, fruit, soup and the like, must necessarily be accomplished at high speed. This imposes rather stringent requirements upon equipment employed and problems of label registry are oftentimes encountered. Additionally difficulties in label feed and the necessity of refilling magazines of pre-cut labels pose problems, particularly in relation to high speed operation.

A further difficulty existing in this general field is the high degree of complexity of labeling apparatus. Such apparatus may require substantial maintenance and is subject to highly undesirable "down time" for such maintenance and possible repair.

The present invention provides a truly continuous high speed method and apparatus for application of labels to containers while at the same time minimizing the complexity of the apparatus.

SUMMARY OF INVENTION

The method and apparatus of the present invention is applicable to the attachment of labels to a wide variety of different types of containers. The invention is, however, described in connection with the application of printed paper labels to cylindrical cans of the type commonly employed in the retail sales of "canned goods".

Individual cans are fed to an input station where they are fixably clamped on the periphery of a rotating drum. The cans are successively moved past a first station where an adhesive is applied to each can at a predetermined location thereon and the cans are then moved on to a labeling station.

Labels are herein provided as a continuous strip of paper or the like upon which there may be previously or at the time of application printed labeling information. A rotary mounted vacuum disc or drum is employed to grip the tape and move labels cut therefrom into position for engagement with the can. After the tape is gripped it is then cut by cutting means including tape return means to ensure a continuous feed of tape onto the drum. The vacuum drum is additionally provided with a particular peripheral configuration including recessed and raised portions for cooperation with an adhesive wheel applying an adhesive to the trailing edge of each label passed thereover by the drum and located at a raised portion of the vacuum drum. Each label is rotated into position for engagement with a can at the location of adhesive on the can at the labeling station.

Both can and label are moving in substantially the same direction at the same speed at the time of engagement of label and can and provision is made for releasing the vacuum holding the label so engaged with the can so that the can moves away from the labeling station with the leading edge of the label adhered thereto. The rotating container drum then moves the can or the like to a wrapping station or discharge station whereat the can is released from the drum and is rolled along a track by a gripping conveyor belt. This then wraps the label about the can and adhesively secures the trailing edge of the label either to the can or in overlapping relation to the leading edge so as to be secured to the label thereat.

DESCRIPTION OF DRAWINGS

The present invention is illustrated as to steps in the method of labeling hereof and as to particular preferred embodiments of the apparatus of the present invention in the accompanying drawings wherein:

FIGS. 11, 12, 13, 14 and 15 are schematic illustration of operations performed at successive positions A, B, C, D and E of FIG. 2.

DESCRIPTION OF PREFERRED EMBODIMENT

There is first set forth herein a brief description of the improved method of the present invention followed by a description of a preferred embodiment of the apparatus of this invention.

It is provided hereby that a large number of containers such as cylindrical cans shall be rapidly operated upon to apply labels thereto. In this respect, labels applied to containers in accordance with the present invention may, for example, wrap entirely about the container or, alternatively extend only a portion of the circumference thereabout. In the following description it is assumed that the label shall be wrapped entirely about a cylindrical container; however, it is understood that those skilled in the art may make such minor modifications or variations in the present invention as will then naturally apply the invention to alternatives as noted above and including other shaped containers.

Figure 1:
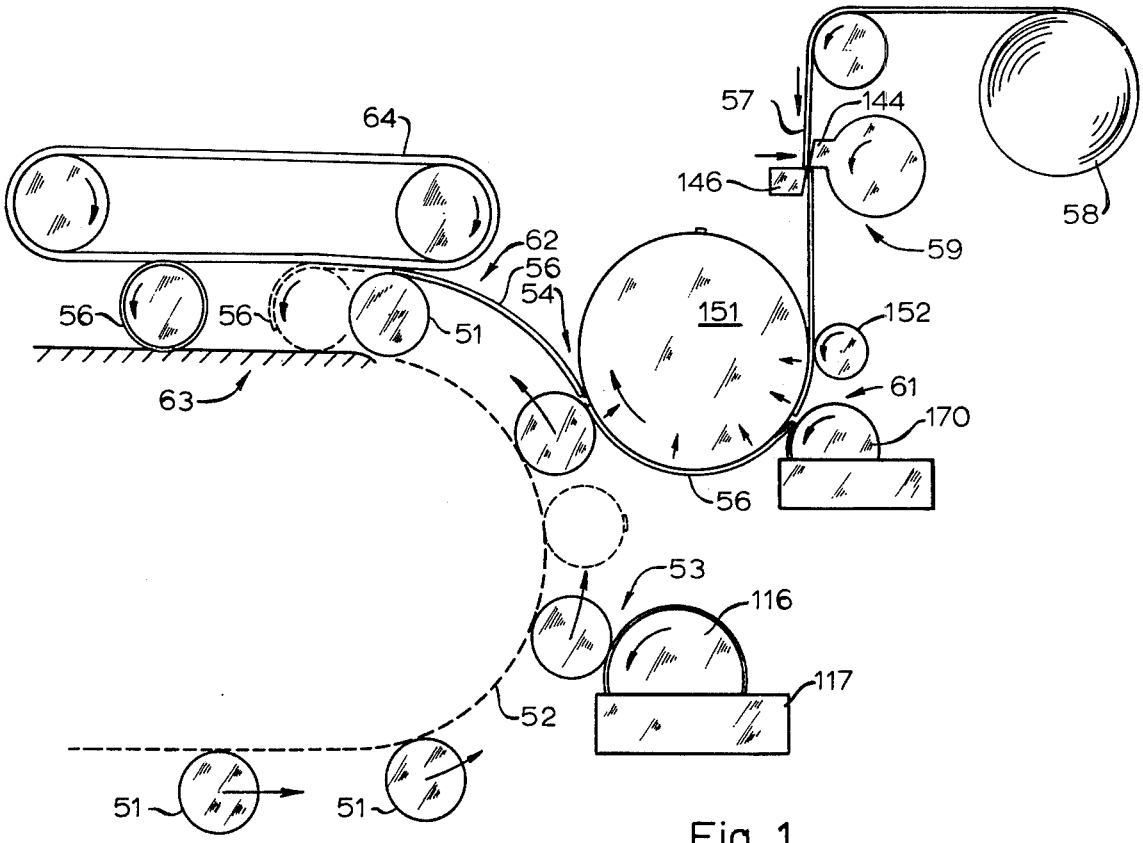
FIG. 1 is a schematic illustration of steps in the method of the present invention.

Considering first the method of the present invention as schematically illustrated in FIG. 1, cylindrical cans 51 are fed successively from a supply thereof for labeling. Each can 51 is moved along a predetermined path which is preferably an arc of a circle as indicated at 52 while retaining the can against rotation about its axis. At an intermediate point along this path 52 adhesive may be applied to a predetermined location on each can, as indicated at 53. The can is then moved further on to a labeling station, as indicated at 54, whereat the label is attached to the can.

Individual labels 56 are provided from an elongated tape or strip 57 which may be mounted upon a reel or the like 58 for continuous supply. Labels are held or mounted as by vacuum to move in an arc into contact with the can at the leading edge of the label at the labeling station 54. The can and label move in substantially the same direction and at the same speed at the time of contact therebetween. Individual labels are cut from the tape or strip 57 as indicated at 59 and after separation from the strip an adhesive is applied to the label at predetermined portions thereof as indicated at 61.

The method of the present invention preferably provides for application of adhesive only to the trailing edge of the label 56 with the leading edge of the label then being attached to the can by adhesive previously applied to the can 53. As soon as the label and can come into contact the label is released as by termination of vacuum gripping of the label so that further movement of the can along its path 52 draws the label with the can.

The can 51 with the label 56 affixed thereto at the leading edge of the label is then released from the restraint from axial rotation and the label is wrapped about the can 51 by rotating the can, as generally indicated at 63. This may be accomplished by placing the can upon a track or the like and forcing the can to roll along the track as by means of a conveyor belt 64 engaging the can. This then causes the label to be wrapped about the can so that the trailing edge of the label having an adhesive on the under side thereof engages the can or the leading edge of the label to secure the label about the can.

It will be appreciated that the above briefly described method of the present invention provides a simple but highly effective manner of applying labels to cans. In particular this method is adapted to very high speed operation as, for example, a labeling rate of 750 cans per minute. It is also to be noted that the method incorporates certain alternatives. Thus, application of an adhesive to the can may be excluded from the process and adhesive applied to the label both at the leading and trailing edge thereof and possibly even in between if such is desired. It is also possible in accordance with the present invention to provide for printing of labels immediately prior to their application to a can so that the tape 57 might thus comprise only a strip of paper or the like. The manner of cutting the labels is also subject to certain variations as, for example, by the provision of a moving knife passing a stationary knife and preferably with provision to ensure that the cut end of the tape then proceeds on along the intended path of the label. Arrows in FIG. 1 indicate such operations. The manner of gripping individual labels and of applying an adhesive thereto is also susceptible to various modifications and reference is made to the following description of an advantageous embodiment of apparatus of this invention in this respect.

Figure 2:
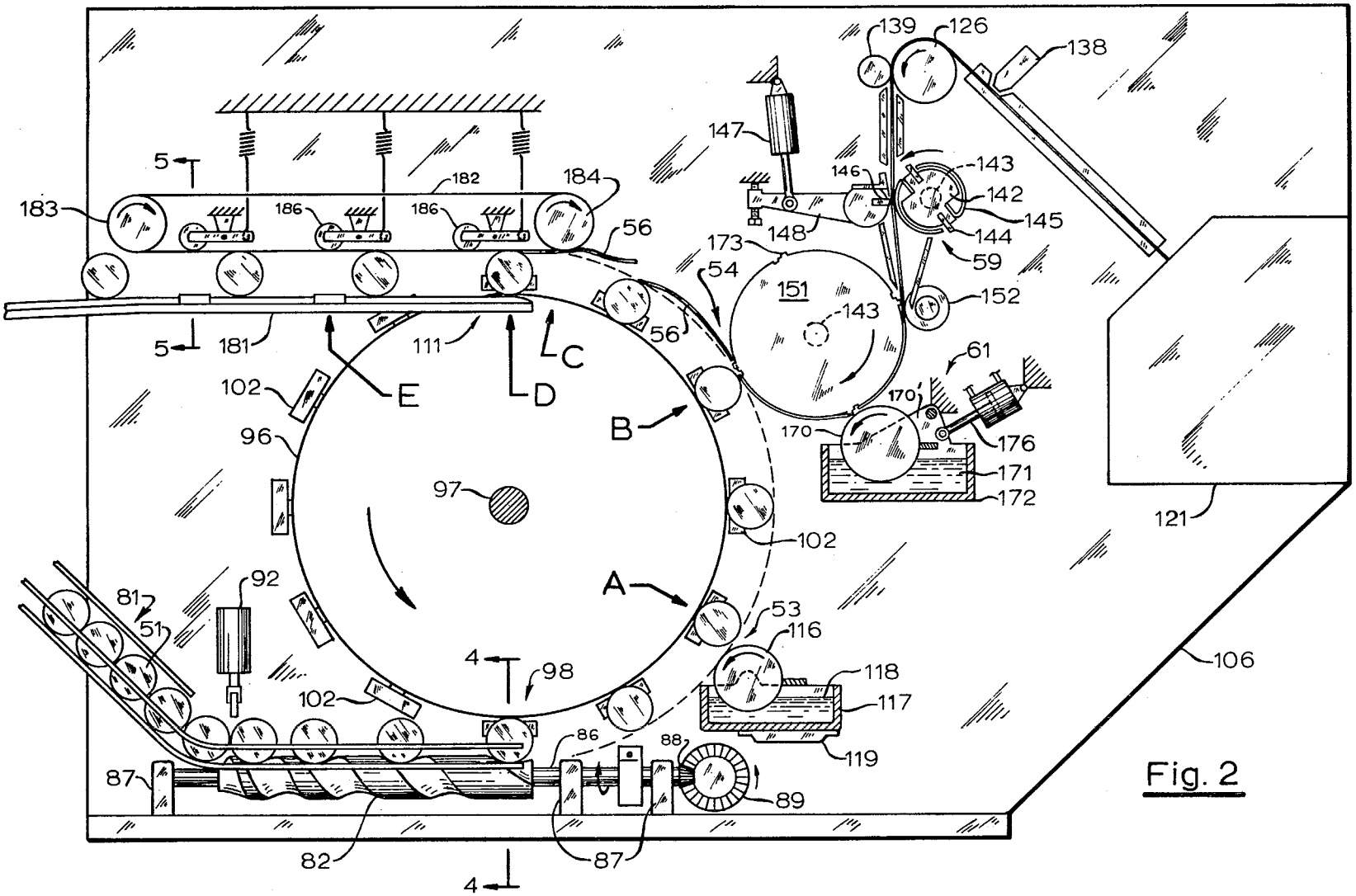
FIG. 2 is a schematic illustration in side elevation of labeling apparatus in accordance with the present invention.

Considering now such advantageous embodiment of the apparatus and referring to FIG. 2, an inclined track 81 is provided, down which there is fed a plurality of cylindrical cans 51 for labeling. Feed means are provided for moving the cans 51 from the lower end of the track and such may, for example, take the form of a helical screw 82. This screw feed mechanism 82 includes a central shaft 86 journalled in bearing mounts 87, and having at the free shaft end a pinion gear 88 engaging a driving bevel gear 89. It is noted at this point that drive means for various elements of the present invention are later described in connection with a schematic illustration thereof. Remotely actuated stop means 92 may also be provided to stop cans from feeding when desired.

A rotatable container transport drum 96 is provided, which may be formed as a pair of circular flanges 96' (FIG. 4) mounted upon a drive axle 97 for rotation with such axle. Containers 51 are engaged by the drum at a receiving station 98 for orbital movement by the drum about the periphery thereof as the drum rotates. Individual containers are engaged by the drum at the receiving station 98 by restraining or gripping means 99 illustrated in FIG. 4. Such means includes a lever 101 pivotally mounted on a shaft carried by a lateral extension of a flange of the drum and having a can engaging a pad 102 at one end of the lever. The other end of the lever carries a cam follower 103 adapted to engage a cam or track 104 mounted upon a rigid structural side plate 106 at the receiving station. A compression spring 107 mounted between the level 101 and the drum flange urges the can receiving end of the lever into can engaging relationship. Thus as each gripping means approaches the receiving station, the cam follower 103 thereof engages the cam surface 104 at the receiving station to pivot the lever 101 into "open" position so that the gripping means receives a can 51 from the feed mechanism 82.

Figure 4:
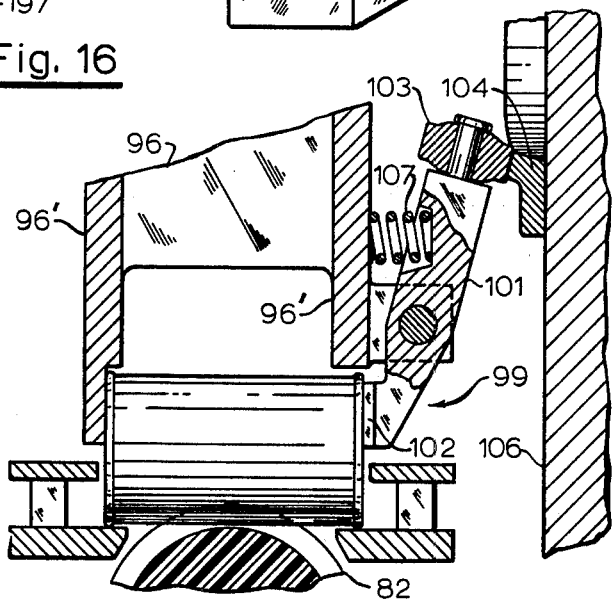
FIG. 4 is a partial sectional view taken in the plane 4—4 of FIG. 2, and illustrating can gripping means on the rotary turret or drum of the apparatus of the present invention.

With the can in position as illustrated in FIG. 4 a continued rotation of the drum moves the cam follower 103 off the high portion of cam surface 104 so that the lever 101 is pivoted by the spring 107 to engage pad 102 against one end of the can, and clamps the same against the left flange 96' appearing in FIG. 4; the right flange 96' being of lesser diameter to allow clearance for pad 102.

The can or container is thus gripped in fixed position on the periphery of the drum for orbital movement about the drum axis, and it is particularly noted that the cans are restrained against rotation about their axes. It will thus be seen that at the receiving station container transport drum 96 engages cans fed to the receiving station by the conveyor means to then move successive cans along the arc of a circle as the drum rotates.

Certain operations are performed upon cans moved about the circular arc of the periphery of the drum as the drum rotates, as described below, and the cans are then released from restraint at a release station 111 by the provision of a second cam surface such as the surface 104 at such location. This then serves to pivot the gripping lever 101 away from the can so that the can is free to move from the drum and such movement is discussed below.

The apparatus incorporates along the path of containers between the receiving and release stations a glue station 53 at which adhesive is applied to the cans, and a labeling station 54, employing the same numerals as those utilized above in connection with the description of the method of the present invention. The glue station 53 comprises a driven glue wheel 116 mounted for rotation upon a vessel 117 containing a liquid adhesive 118. Preferably this liquid adhesive comprises a hot melt (molten resin) maintained in molten state by suitable heating means 119. The glue wheel 116 is disposed with the periphery thereof on the circle described by the outer periphery of containers moved about the axis of the drum 96 as the drum rotates. Consequently, as individual containers pass the glue station, the outermost periphery thereof will touch the glue wheel 116 to pick up a line or pattern of dots of adhesive. Glue wheel 116 is preferably driven as can be seen from FIG. 16.

Figure 3:
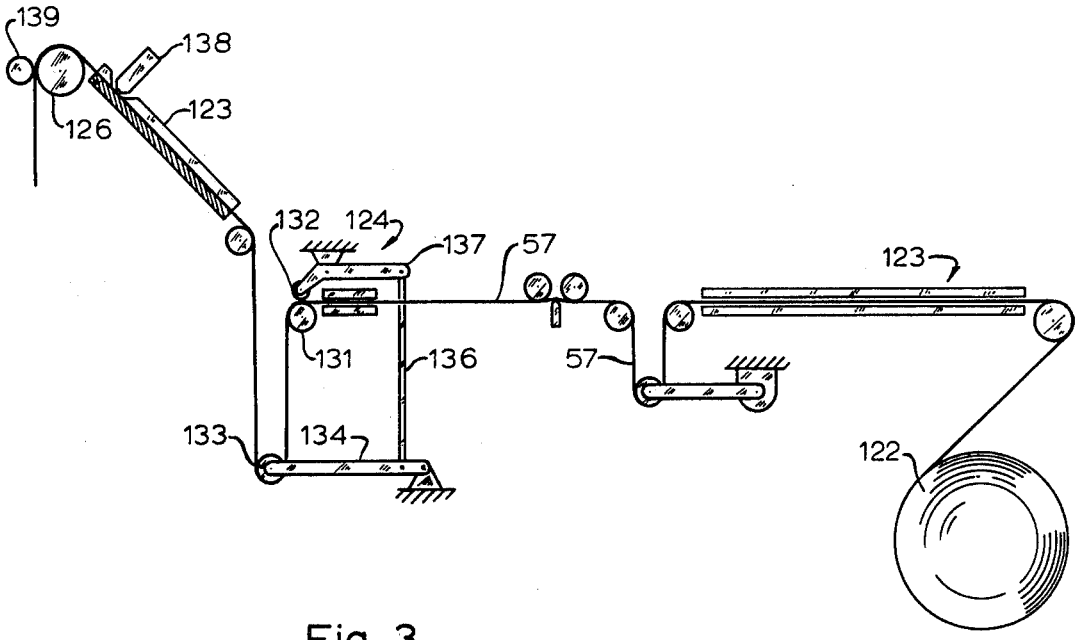
FIG. 3 is a schematic illustration of tape feed apparatus employed with the labeling apparatus of FIG. 2.

Following the glue station 53 in the traverse of cans or containers between the receiving and discharge stations, there is provided the labeling station, as it is termed herein. Considering now the labeling station 54, it is first noted that the present invention provides for employing an elongated continuous parent strip or tape 57 of material from which individual labels are formed for application to cans or containers. Tape supply is indicated at 121 in FIG. 2 and is shown in more detail in FIG. 3. As shown in FIG. 3 the strip may be provided upon a reel 122 and fed through guides 23 and tensioning and slack pick-up means 124 and about a tape drive roller 126. The slack pick-up mechanism 124 may be substantially the same as that described in my above-noted copending patent application, and generally will be seen to include a drive roller 131 over which the tape passes with a second pivotally mounted roller 132 controllably bearing on tape passing over the drive roller. Following the drive roller the tape passes beneath a freely rotatable dancer roller 133 mounted on a pivotally mounted lever 134. The pivotal location of the freely rotatable roller 133 depends upon the amount of slack in the tape between the drive roller 131 and the main drive roller 126. A bar 136 connects the lever 134 and a free end of a pivotally mounted lever 137 mounting the roller 132. As the amount of tape between the rollers 132 and 126 increases, the freely mounted roller 133 will drop down to ride on this tape and thus through the levers and bars 134, 136 and 137, will pivot the roller 132 away from the drive roller 131 so as to slow down the feed of tape until the slack is taken up. There is also provided a registering device 138 located ahead of the main drive roller 126 and including, for example, a conventional photo sensing device to establish correspondence between an individual label in the strip to the length of an individual label to be cut from the strip. An idler roller 139 engages tape passing over the main drive roller 126.

Figure 9:
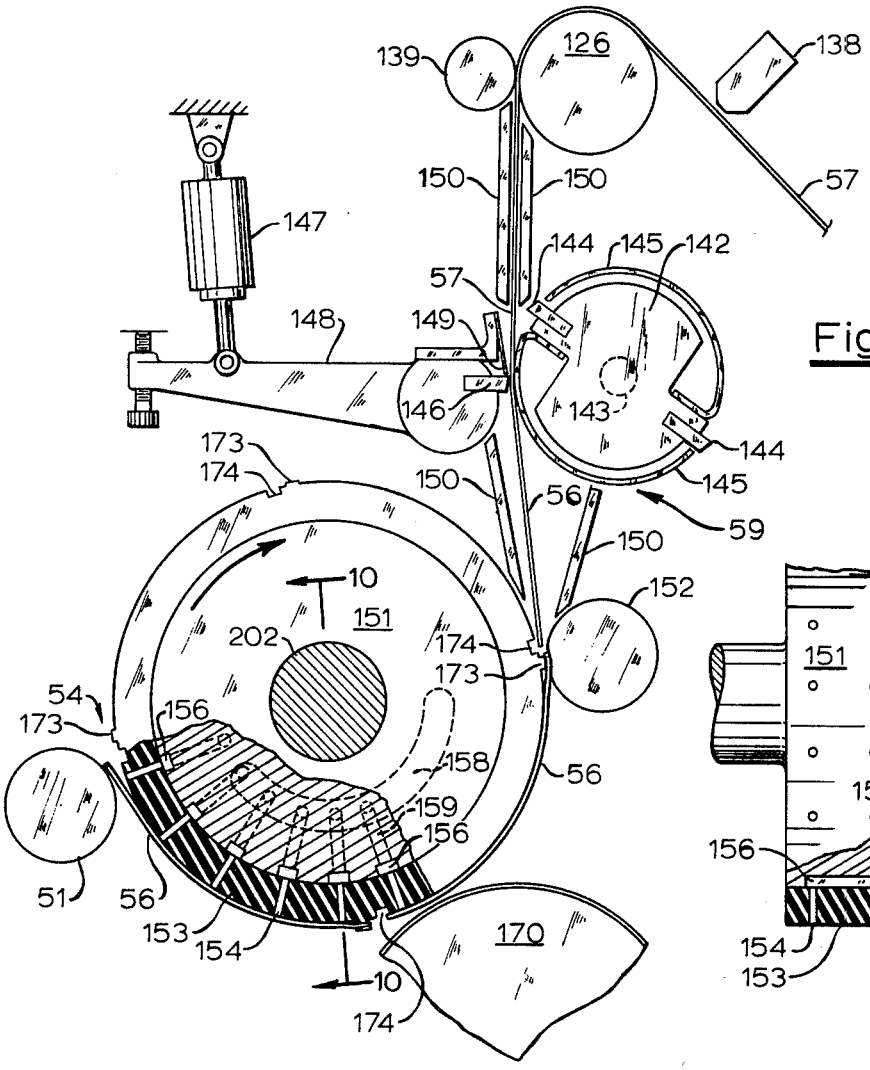
FIG. 9 is an enlarged partial view of the labeling station, also showing cutting means and means for applying adhesive to labels.

Provision is made for cutting from the tape 57 individual labels for application to containers or cans and to this end a cutting station or assembly 59 is provided. This station as illustrated in FIGS. 2 and 9 is comprised as a single pair of cutting assemblies with the first thereof including a rotatable drum 142 mounted on a shaft 143 and carrying a pair of cutting blades 144. It will be appreciated that the number of cutting blades 144 may vary depending upon the diameter of the drum 142 and the speed of rotation thereof. The drum shaft 143 is driven by suitable means in conjunction with other components of the apparatus, as can be seen from the schematic view of FIG. 16. The drum 142 may include adjustable guards 145 to prevent tape movement against the drum.

The second cooperating cutting assembly comprises a stationary shear member or blade 146 disposed in position to cooperate with the blades 144 of the rotating drum 142 so as to sever tape passed between the shear member and drum 142. Provision may be also made for moving shear member 146 away from drum 142 as by means of a hydraulic or pneumatic cylinder 147 operating upon a pivoted arm 148 carrying the shear member. This thus provides for preventing engagement of the rotating blades 144 and the shear member 146 when no tape is being fed to the apparatus.

Figure 6:
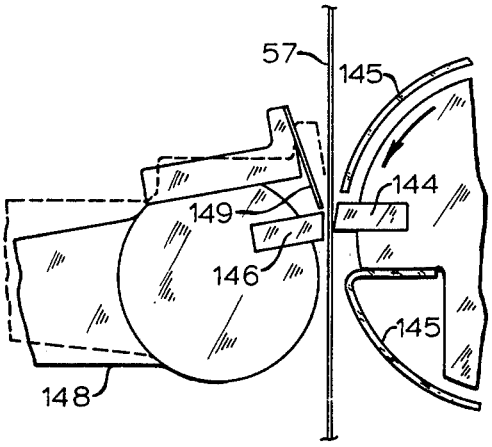
FIGS. 6, 7 and 8 are schematic illustrations of label cutting means and various positions of operation thereof.
Figure 7:
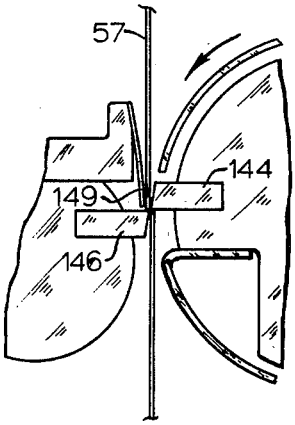
Figure 8:
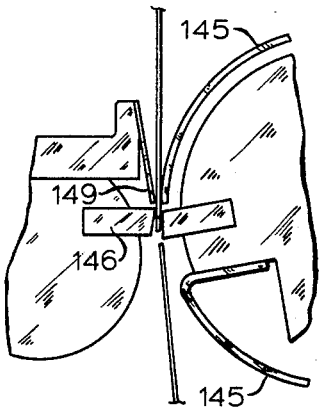

A problem encountered in cutting successive lengths from a tape by means of a single cutting assembly 59, as described above, is the possibility of the leading end of tape fed into the cutting means, engaging the shear member immediately following a cutting operation so that the tape is blocked and hence not fed through the cutting means. An important aspect of the invention is the provision of means preventing occurrence of the above-noted problem and in this respect reference is made to FIGS. 6, 7 and 8 illustrating different positions of the cutting members. In FIG. 6 there is shown the retracted or inactive position of shear member 146 wherein the arm 148 mounting same is pivoted upwardly as by the hydraulic or pneumatic cylinder 147 of FIG. 2. FIG. 7 illustrates shear member 146 in normal or fixed operative position for tape cutting with a rotating cutting blade 144 engaging same to sever tape 57. It will be seen that at this particular position the upper portion of the tape is forced inwardly after being cut to rest upon the top of stationary shear member 146.

A resilient blade 149 is fixedly mounted on arm 148, and urges the tape to the right in the illustration, away from stationary shear member 146. Thus, as the rotating cutter blade 144 moves past shear member 146, resilient blade 149 pushes the cut end of the tape 57 outwardly of the shear member so that it will pass over the shear member as illustrated in FIG. 8, and not be blocked. This then prevents possible kinking or hang-up of the tape on the shear member immediately following cutting of a label from the tape. There are also provided suitable guides 150 for the tape at the cutting station and for the cut labels leaving the station.

Figure 10:
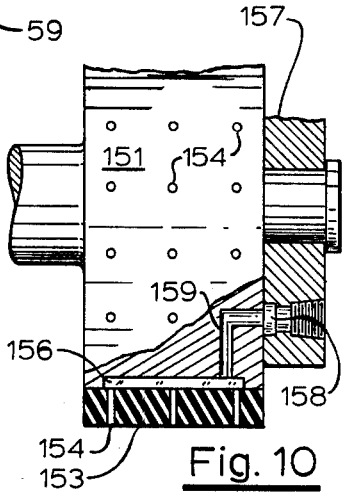
FIG. 10 is a partial sectional view of the vacuum drum of the labeling station of the present invention taken in the plane 10—10 of FIG. 9.

Labeling station 54, as illustrated in FIGS. 2, 9 and 10, comprises a vacuum drum 151 disposed immediately below cutting station 59 and includes a rotary mounted wheel 152 substantially engaging the periphery of the drum 151 below the engagement of cutting means of the cutting station. Vacuum drum 151 is provided to grip and transport individual labels from the cutting station to engagement with individual cans or containers 51 passing the labeling station. Roller 152 rotates freely while the vacuum drum is rotatably driven. The leading or lower end of tape 57 is engaged between the vacuum drum and roller 152 immediately prior to the cutting of the tape to form a label that is then held and carried about the vacuum drum as it rotates.

Considering further vacuum drum 151 and referring particularly to FIGS. 9 and 10, it will be seen that the drum is provided with an outer rim 153 which may be formed of rubber or the like and which is provided with transverse rows of radial openings 154 therethrough. Each row of openings 154 across the drum rim communicate with a separate radial drum passage 156. The drum 151 rotates against a fixed block or the like 157 having a vacuum manifold 158 therein extending in an arc about somewhat less than 180° of drum rotation again as indicated in FIG. 10. The drum passages 156 individually extend to a side of the drum adjacent to block 157 for communication with the vacuum manifold 158 through passages 159, over a predetermined arc of rotation of the drum. Manifold 158 is adapted for connection to a vacuum source to thus draw a vacuum through the peripheral openings 154 in the drum for a portion of each drum rotation.

The present invention furthermore provides for the application of an adhesive to the outer face of labels carried by the vacuum disc 151. To this end there is provided the adhesive station 61 illustrated in FIG. 2, and including a rotary mounted wheel 170 dipping into a pool 171 of liquid adhesive disposed in an open topped container 172. It is preferred in accordance with the present invention that adhesive shall be applied to the label at the trailing edge thereof, and this is accomplished by forming small radial projections 173 (FIGS. 2, 9 and 12), on the outer periphery of and extending transversely of vacuum drum 151 and spaced apart about such periphery a distance slightly greater than the length of each label. Immediately behind each projection 173 there is provided a transversely extending channel or groove 174 in the periphery of the vacuum drum. The spacing is such that each cut label 56 is placed on the drum with the leading edge of the label immediately over a groove or depression 174 and extends about the periphery of the drum to dispose the trailing edge of the label upon a radial projection 173.

The adhesive applying wheel 170 is rotatably mounted on a pivotally mounted bracket 170' (FIG. 2) which is periodically actuated toward and away from wheel 170 a short distance of about $\frac{1}{8}$ inch in timed relationship with travel of successive labels, by suitable actuating mechanism generally illustrated at 176, to apply the adhesive only to the trailing edge portion of each label which rests on projection or ridge 173. The ridge raises the tail or trailing edge of the label to enhance contact thereof with the adhesive applying wheel for application of the adhesive to the trailing edge of the label. The channel or recess 174 in back of each ridge 173 serves as a means to receive any excess of adhesive applied by wheel 170 to the label to preclude build-up of adhesive on the vacuum drum with consequent fouling of the drum.

It is thus seen that as individual labels 56 are severed from the parent tape 57 following gripping of the leading edge of the label between the vacuum drum and wheel 152, each label is drawn by vacuum application into contact with the drum periphery and moved by the vacuum drum in an arcuate path substantially tangent to the side of a container, into position for engagement with a can or container 51 carried by the drum 96. While on the vacuum drum, adhesive is applied by wheel 170 to the back side of the trailing edge of each label. Referring again to FIGS. 2 and 9, it will be seen that the back side of the leading edge of a label is applied to can 51 on the hot melt adhesive which had been previously applied to the can as the can and label move in substantially the same direction at substantially the same speed. Thus, the peripheral velocity of vacuum drum 151 is made equal to the peripheral velocity of the container carrying drum 96; and at the point of initial contact of label and can both the can and the label are moving in substantially the same direction and at the same speed. The application of vacuum to the openings 154 in the periphery of the vacuum drum is terminated at the same time as the leading edge of the label engages the hot melt adhesive on the can to free the label from the drum. The can then moves away from the vacuum drum to pull the label from the drum so that the label follows the container along its path with the tail of the labellloosely trailing as shown in FIGS. 1 and 2.

The can, with the leading edge of the label secured to the periphery thereof by the hot melt adhesive, is then moved to the discharge station 111. At the discharge station the individual cans are released from the gripping means 99 so as to be free to rotate about their axes. Also, at the discharge station the cans move onto a track 181 preferably having a frictional surface to preclude slippage. The movement of cans onto the track is accomplished by an endless belt 182 passing about a pair of belt wheels or rollers 183 and 184 and formed, for example, with a cogged interior surface to engage such wheels, at least one of which is driven. There are additionally provided spring loaded idler rollers 186 engaging the lower portion of the belt loop on the upper surface thereof and the belt is disposed in position to engage the upper surface of each can as it enters the discharge station 111. It will thus be appreciated that, inasmuch as the cans are released from the gripping means at the discharge station, the belt 182 will roll the cans along the track 181 to thus consequently wrap the label 56 about the can. The label is preferably cut slightly longer than the can circumference so that the trailing edge of the label will overlap the leading edge and become adhered thereto.

The successive steps of label application are particularly illustrated in the schematic showings of FIGS. 11 to 15 representing can and label positions at locations A, B, C, D and E, respectively, of FIG. 2. Referring now to these FIGS. 11-15 it is noted that at station A a line or series of dots of hot melt adhesive 120 are applied to each can 51 moving past glue station 53. The application of adhesive, desirably a molten resin, to the can insures adherence of the label and facilitates removal of the label from the vacuum drum.

At labeling station B (FIG. 12) the leading edge of a label 56 is moved in the same direction and at the same speed as the glue line 120 on the can and into engagement with same. The label is then released from the vacuum drum to move with the can as it continues its course about the periphery of the container drum 96, and this condition is illustrated in FIG. 13 wherein the can having the leading edge of a label attached thereto approaches the moving belt 182. As the belt engages the can it rolls the can along the track 181 as illustrated at FIG. 14 to thus wrap the label about the can.

Completion of the wrapping operation is illustrated in FIG. 15 wherein the trailing edge of the label with an adhesive from the labeling station at vacuum drum 151 overlaps the leading edge of the label and is pressed thereagainst by the belt preferably backed by a spring loaded roller 186 thereat. The rollers 186 may be mounted for free rotation and also limited spring loaded vertical movement as indicated in FIGS. 2 and 15 to accommodate passage of the overlapped label through the discharge station and to apply an added pressure to the adhered overlap.

The cans will thus be seen to be rapidly and simply labeled by a truly continuous high speed operation. Complexities of apparatus are minimized hereby, and consequently problems of maintenance and repair are likewise minimized. Truly high speed operation is achieved by the present invention to thus commend the method and apparatus hereof to widespread commercial application.

Figure 16:
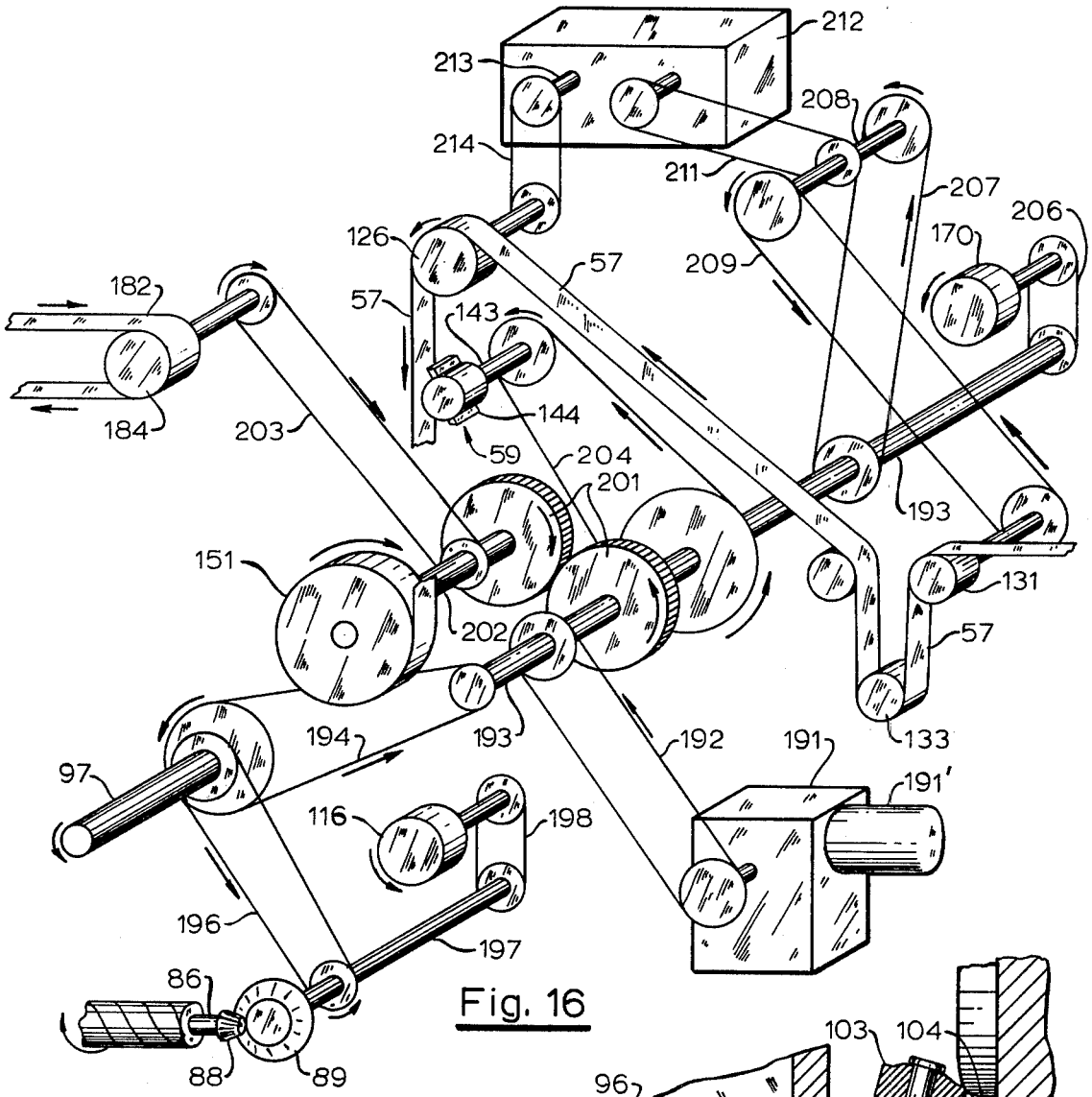
FIG. 16 is an isometric schematic illustration of drive means for apparatus of the present invention.
Figure 5:
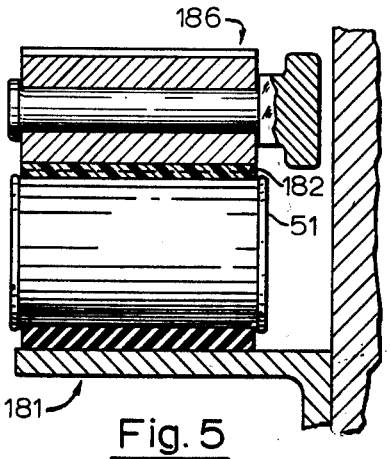
FIG. 5 is a partial sectional view in the plane 5—5 of FIG. 2 illustrating can rotating means in the wrapping station of the present invention.

Any suitable drive means may be employed for operating the elements of the present invention in timed relationship. FIG. 16 illustrates schematically a suitable system comprising a main drive gear box 191, driven by a variable speed motor 191'. Gear box 191 is connected by means including chain 192 to drive a main power shaft 193 in a counter-clockwise direction, as indicated by the direction arrow in FIG. 16.

Shaft 193 is connected by means including chain 194 to drive the container drum shaft 97; and shaft 97 is connected by means including chain 196 to a take-off shaft 197 to which pinion 89 is secured and which drives screw conveyor 82. Take-off shaft 197 is connected by means including chain 198 to drive the hot glue applying wheel 116. Vacuum drum 151 is driven from shaft 193 by means of gearing 201 and shaft 202; and means including chain drive 203 is provided to drive endless belt 182 by which the labels are wrapped around the containers. Also, the cutting mechanism indicated at 59 is driven from shaft 193 by means including chain 204; and glue applying wheel 170 which applies adhesive to the label on the drum, is driven from shaft 193 by means including chain 206.

The means for driving tape driving wheel 131, appearing also in FIG. 3, is likewise from shaft 193 by means including chain 207, shaft 208 and chain 209. Because of slack which may occur in the tape 57, the other drive wheel 126 for the tape (also appearing in FIG. 3) is driven by means including chain 211 connected to an automatically controlled differential indicated at 212, the output shaft 213 of which is connected by chain 214 to wheel 126. The differential 212 is electronically controlled by the conventional photoelectric sensing means 138 (FIGS. 2 and 3) to synchronize label spacing on tape 57 with the cutting knives 144–146.

I claim:

1. Can labeling apparatus comprising a rotary mounted container drum having can gripping means at circumferentially spaced locations about the periphery for holding cans against rotation about the axes thereof, means rotating said container drum to thus move cans on the drum in a circular arc, a vacuum drum mounted for driven rotation about the axis thereof and disposed with the periphery thereof substantially tangent to the side of cans on said container drum as they move past the vacuum drum, said vacuum drum having peripheral openings controllably connected to a vacuum source for releasably holding can labels on the drum periphery as the vacuum drum rotates and also having a plurality of radial ridges thereacross spaced apart a predetermined distance circumferentially about the periphery of the drum to displace at least a portion of each label radially outward of the drum, such spacing being slightly greater than the length of the individual labels, an adhesive wheel for coating adhesive on each label while on a ridge, means for continuously feeding a parent strip of label material onto the periphery of the vacuum drum with its leading edge held by the vacuum drum and the portion of the parent strip which is to form the trailing edge of the label unsevered from the strip, means operable while said leading edge is held by the vacuum drum for cutting successive labels from the strip at a location ahead of said vacuum drum, means for rotating the vacuum drum to effect movement of individual labels cut from said strip to engage the adhesive wheel at said ridges and then to engage a can at the leading edge of the label, and means releasing successive cans from the container drum at a discharge station and rotating the released cans for wrapping a label about each can to secure the label about the can.

2. The apparatus of claim 1 further defined by an adhesive station comprising a rotatable adhesive applying wheel mounted with the periphery thereof adjacent sides of cans carried by said container drum toward said vacuum drum for applying adhesive to each container prior to label application.

3. The apparatus of claim 1 further defined by said vacuum drum having radial grooves disposed one behind each ridge for receiving excess adhesive and thus preventing fouling of the drum with adhesive.

4. Labeling apparatus comprising means for continuously conveying a plurality of substantially cylindrically shaped objects in spaced apart relationship, a vacuum drum mounted for rotation about the axis thereof and disposed with the periphery thereof adjacent to the sides of said objects as they move past the vacuum drum, said drum having peripheral openings controllably connected to a vacuum source for releasably holding labels on the periphery of said drum and also having a plurality of transversely extending radial ridges spaced apart a predetermined distance circumferentially about the periphery of said drum to displace at least a portion of each label radially outward of the drum, the spacing between the ridges being greater than the length of the individual labels, an adhesive wheel for coating adhesive on each label while on a ridge, a transversely extending radial channel immediately behind each ridge to receive excess adhesive and thus prevent fouling of the drum with adhesive, means for continuously feeding a parent strip of label material onto the periphery of the vacuum drum with its leading edge held by the vacuum drum and the portion of the parent strip which is to form the trailing edge of the label unsevered from the strip, means operable while said leading edge is held by the vacuum drum for cutting successive labels from the strip at a location ahead of said vacuum drum, means for rotating the vacuum drum to effect movement of individual labels cut from said strip to engage the adhesive wheel at said ridges and then to engage a substantially cylindrical object at the leading edge of the label, and means for rotating each substantially cylindrical object for wrapping a label about the object.

* * * * *